US005165426A

United States Patent [19]

Klammer et al.

[11] Patent Number: 5,165,426

[45] Date of Patent: Nov. 24, 1992

[54] PROCESSING OF TOBACCO LEAVES

[75] Inventors: Barbara C. Klammer; David J. Molyneux, both of Southampton; Roy L. Prowse, Eastleigh, all of England

[73] Assignee: British-American Tobacco Company Limited, London, England

[21] Appl. No.: 580,944

[22] Filed: Sep. 11, 1990

[30] Foreign Application Priority Data

Aug. 18, 1989 [GB] United Kingdom ..... 8921113
Jun. 1, 1990 [GB] United Kingdom ..... 9012234

[51] Int. Cl.[5] ..... A24B 5/10
[52] U.S. Cl. ..... 131/311; 131/290
[58] Field of Search ..... 131/311, 312, 290, 327

[56] References Cited

U.S. PATENT DOCUMENTS 3,696,817 10/1972 Bonner .
3,706,314 12/1972 Smith .
3,861,400 1/1975 Perkins et al. ..... 131/335
3,931,824 1/1976 Miano et al. ..... 131/359
4,248,253 2/1981 Cogbill, II ..... 131/312
4,323,083 4/1982 Cogbill, II ..... 131/312
4,328,816 5/1982 Cogbill, II ..... 131/312
4,557,278 12/1985 Brackmann .

FOREIGN PATENT DOCUMENTS 954136 8/1964 Fed. Rep. of Germany .
139007 4/1966 New Zealand .
2134 of 1855 United Kingdom .
413486 7/1934 United Kingdom .
1483082 8/1977 United Kingdom .
2078085B 1/1980 United Kingdom .
2026298A 2/1980 United Kingdom .
2118817B 11/1983 United Kingdom .
2119220A 11/1983 United Kingdom .
2131671A 6/1984 United Kingdom .
2176385A 12/1986 United Kingdom .

*Primary Examiner*—Vincent Millin
*Assistant Examiner*—Lynne A. Reichard
*Attorney, Agent, or Firm*—Kane, Dalsimer, Sullivan, Kurucz, Levy, Eisele and Richard

[57] ABSTRACT

Lamina and stem components of tobacco leaf are fed simultaneously to a milling machine such that there is produced a fluent mixture of lamina and stem particles. The mixture, with little or no further particle size reduction can be fed to a cigarette making machine.

49 Claims, 12 Drawing Sheets

PROCESSING OF TOBACCO LEAVES

BACKGROUND OF THE INVENTION

1. Field of the Invention

This invention relates to the processing of tobacco leaf material in the manufacture of smoking articles.

2. Brief Description of Related Art

Tobacco leaves of the types used in the manufacture of cigarettes and like smoking articles comprise leaf lamina, a longitudinal main stem (rib) and veins extending from the main stem. The main stem and large veins are hereinafter jointly referred to as 'stem'. The stem has substantially different physical properties from the lamina, and it is long-established practice to separate the stem from the lamina at an early stage in the processing of tobacco leaves, the stem and lamina then being processed independently and differently.

The manner in which stem material is separated from lamina material is generally by means of a complex and large threshing plant comprising a number, eight for example, of serially arranged threshing machines with classification units disposed intermediate next adjacent threshing machines.

As is well known, the separated stem material, or a proportion of it, after suitable reduction in size, is often added back to the lamina after the lamina has been subjected to further processing. Stem material is often desirable in the tobacco blend to improve fill value.

It is general practice in the reduction of stem size for the size reduction to take place when the moisture content of the stem has been raised to a high level of approximately 30–50%, whereas reduction in the size of lamina material is generally undertaken at moisture contents in the region of 18–24%, the precise value depending very much on the type of tobacco, its treatment and the precise cutting conditions.

It is an object of the invention to provide an improved method of processing tobacco leaf material to provide a product suitable for use in smoking articles, cigarettes and cigars for example.

We have looked at ways of simplifying the overall tobacco producing process from leaf to smoking article.

We have found that it is possible to use a mill for the purpose of operating simultaneously on stem and lamina to produce a product useful for incorporation in smoking articles. Whilst we are aware that it has been proposed to use a disc mill to reduce the particle size of stem material on its own, we are not aware of any use of a single mill for simultaneously reducing lamina and stem to a particulate mix of: lamina and stem which is capable of being used for making smoking articles without any substantial further size-reduction process.

Prior proposals for the processing of tobacco leaves to provide filler for cigarettes and like smoking articles are numerous. Examples are to be found in the following patent specifications:

Germany (Federal Republic): 954,136.

New Zealand: 139,007.

United Kingdom: 1855/2134; 413,486; 2,026,298; 2,078,085; 2,118,817; 2,119,220 and 2,131,671.

United States: U.S. Pat. Nos. 55,173; 68,597; 207,140; 210,191; 250,731; 358,549; 360,797; 535,134; 2,184,567; 3,026,878; 3,128,775; 3,204,641; 3,690,328; 3,845,774; 4,195,646; 4,210,157; 4,248,253; 4,323,083; 4,392,501; 4,582,070; 4,696,312 and 4,706,691.

SUMMARY OF THE INVENTION

According to one aspect thereof the present invention provides a method of processing tobacco leaf material, wherein tobacco leaf lamina and tobacco leaf stem are fed together through a leaf reduction apparatus, the arrangement of said apparatus and the processing conditions being such that there exits said apparatus a product which is a mixture comprising flakes of said lamina and shreds of said stem.

According to another aspect thereof the present invention provides a smoking material comprising a mixture of lamina particles and stem particles, which material is the product of feeding tobacco leaf lamina and tobacco leaf stem together through a leaf reduction apparatus.

Lamina and stem fed to the leaf reduction apparatus are suitably comprised in whole leaf, as hereinbelow defined. However, the lamina, or a proportion thereof, fed to the apparatus can be lamina prior separated from attached stem. Similarly, the stem, or a proportion thereof, fed to the apparatus can be stem prior separated from attached lamina.

By "whole leaf" we mean complete, or substantially complete, leaves or leaves which have been reduced in size by a reduction process, such as chopping or slicing for example, that does not involve any significant separation of lamina and stem. The leaves or leaf portions will generally have been cured and may have been subject to other more or less conventional treatments.

According to a further aspect thereof the present invention provides a method of processing tobacco leaf material to provide smoking article filler material, wherein tobacco as whole leaf, as hereinbefore defined, passes through a passage defined by co-extensive portions of first and second, relatively moving, milling elements of a leaf reduction apparatus from an inlet of said passage to an outlet of said passage remote said inlet, so as to provide at said outlet filler material comprising a mixture of lamina particles and stem particles. Preferably, the outlet of the passage is situated at the margin of the co-extensive poritons.

BRIEF DESCRIPTION OF THE DRAWINGS

Each shape factor value shown against the horizontal axes of the histograms constituting FIGS. 3 and 4 is the upper value of a unit range. Thus the value "0.4", for example, signifies that the range extends from the least value above 0.3 up to a maximum of 0.4.

DETAILED DESCRIPTION OF THE PREFERRED EMBODIMENTS OF THE INVENTION

Figure 1:
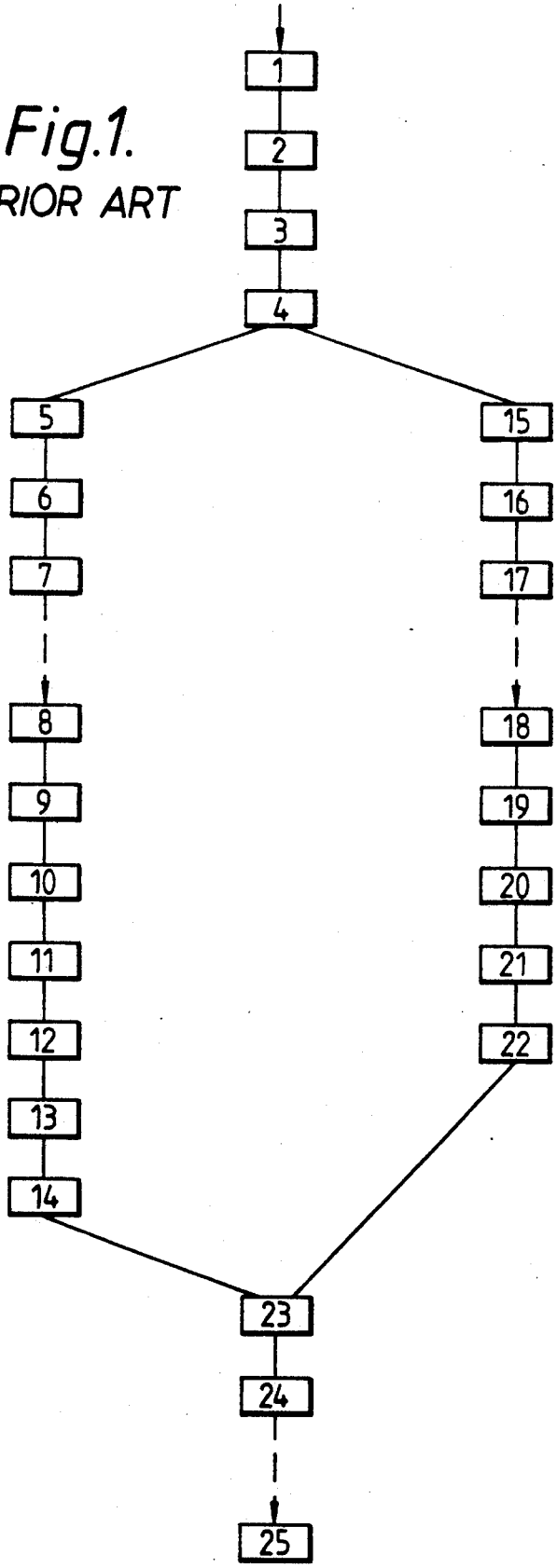
Fig.1. PRIOR ART
FIG. 1 is a block diagram relating to a conventional processing of flue-cured whole tobacco leaf.

Advantageously, a gravity feed system is used for feeding the leaf material to the inlet of the leaf reduction apparatus.

It may, in some cases, be found to be advantageous to inject low pressure steam, at one bar for example, into the leaf reduction apparatus.

The feed of leaf material to the leaf reduction apparatus may be assisted by the maintenance at the product outlet of the apparatus of a reduced air pressure, as for example, by way of use of an air lift, or by the maintenance of an elevated air pressure at the product inlet of the apparatus.

Preferably, the feed of the leaf material to the leaf reduction apparatus should be a continuous feed. It is advantageous for the feed rate to be substantially constant.

According to a yet further aspect thereof the present invention provides a smoking article filler material, which filler material is a fluent mixture comprising lamina particles and stem particles, the shape factor of about 60 percent or more of the dust free particles of which mixture is 0.5 or above.

The concept of "shape factor" is defined hereinbelow.

According to a yet further aspect thereof the present invention provides a method of making cigarettes, wherein tobacco bale material is reduced to provide discrete whole leaf, as hereinbefore defined; the whole leaf is fed through a mill such that there exits said mill a product which is a mixture comprising flakes of lamina and shreds of stem; and said mixture is fed to a cigarette rod making machine.

We have found that, surprisingly, methods in accordance with the invention can be performed on whole leaf having a moisture content which is significantly less than the moisture content normally employed for the size-reduction of stem. The moisture content may, for example, be in the region of half that conventional for the size-reduction of stem.

This is, of course, unexpected because one would have thought that the power needed to fiberise/shatter/disintegrate stem when it is in a relatively dry and strong condition might have led to an unacceptably extreme reduction in size of the accompanying lamina, whereas it has been found that the shattered lamina size can be controlled within acceptable limits. It was also unexpected that at low moisture contents, moisture contents in the region of 20% for example, the stem did not break down to form an unacceptable material. That is to say, the size and size distribution of both the lamina particles and the stem particles are such that mixtures thereof in accordance with the invention are suitable for being fed to a commercial cigarette rod making machine, a Molins Mk 9 for example.

In the conventional method of processing tobacco leaf material to produce cigarette filler material, the cut lamina product of the lamina processing line is mixed with the cut rolled stem product of the stem processing line. With a view to obtaining a reasonable degree of uniformity of filler character between cigarettes, attempts are made to thoroughly mix the two products. However, the respective forms of the two products are such that the products do not readily mix. Thus the further the mixing objective is pursued, the greater is the tobacco particle degradation likely to be. It is thus a significant advantage of the invention that it is an important feature thereof that in products of the invention the lamina particles and the stem particles are in intimate admixture.

Since the moisture content (of the stem fraction) can be relatively low, there is a reduced requirement for drying of the product of the size reduction apparatus, which can lead to considerable savings in equipment and energy costs.

A smoke modifying agent, a tobacco casing for example, can be applied to the tobacco leaf material before or after the processing thereof by a method in accordance with the invention.

Products of the invention can be subjected to a tobacco expansion process. Examples of expansion processes which could be employed are disclosed in United Kingdom Patent Specifications Nos. 1 484 538 and 2 178 385.

It has been found that the moisture content of whole leaf is generally the main factor which determines whether, on the one hand, stem particles are produced, or on the other hand, substantially intact stem is produced, and that, surprisingly, a sharp transition from the one product to the other product occurs at a fairly precise moisture content.

The moisture content at which this transition occurs will hereinafter be referred to as the "transistion moisture content".

The transistion moisture content of a tobacco material to be milled is readily determined by simple experimentation prior to production operation. For a Virginia tobacco whole leaf, when milled in a Quester SM11 mill, the transition moisture content was found to be substantially 18%. An upper limit of substantially 70% for producing a mixture of lamina flakes and stem shreds was found, above which the material homogenised and clogged together in an unworkable manner.

Suitably, the upper moisture content of whole leaf material employed in processing methods in accordance with the invention does not exceed about 35%, and more suitably does not exceed about 30%.

A moisture content of about 30% at input to the leaf reduction apparatus may be appropriate where it is intended to subject the product to an expansion process in which the mixture of lamina and stem particles will be in contact with a hot gaseous medium.

Heat may be applied to the tobacco material to be fed to the leaf reduction apparatus. If heat is applied, as for example by subjecting the material to microwave radiation, the value of the transition moisture content will tend to be depressed.

Leaf material processed by a method in accordance with the invention may be of a single tobacco grade or a blend of leaf materials of a plurality of tobacco grades. When such a single grade constitutes a small proportion only of a blend, it can be the case that even if the single grade is of a moisture content less than the transition moisture content, a product of the invention can be produced so long as the mean moisture content of the blend is above the transition moisture content.

Since a leaf reduction apparatus used in carrying out a method in accordance with the invention is substantially more compact than a conventional threshing plant, with its plurality of threshing machines and classifiers and extensive associated air trunking, there will be, in use of our invention, a capital cost saving relative to the use of a conventional threshing plant. There will also be a saving in energy consumption. Furthermore, capital and energy cost savings will accrue from simplification of the primary leafprocess section in the tobacco factory. It is thus the case that by use of the present invention significant savings can be made in the overall tobacco leaf process, i.e. that process which commences with tobacco leaf as received from the farm and which ends with the making of cigarettes or other smoking articles.

It is to be observed that not only does the invention provide methods of simultaneously size reducing lamina and stem, to provide a mixture of discrete lamina particles and discrete stem particles, without a requirement for a serially arranged plurality of leaf processing machines, but furthermore, the invention provides methods which are readily carried out without a requirement to recirculate product for further size reduction. In other words, single pass operation is readily achieved.

Figure 9:
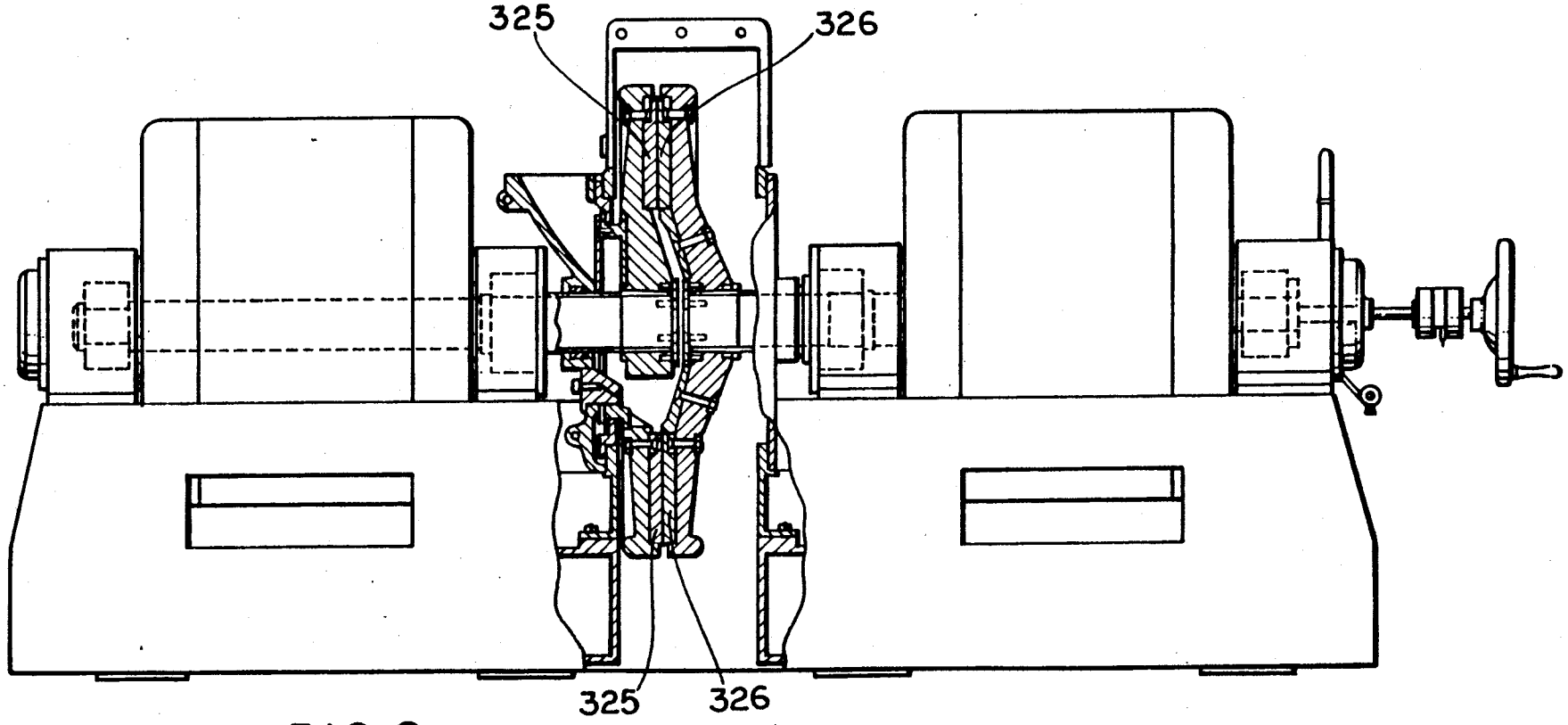
FIG. 9 PRIOR ART
FIG. 9 is a side view, partially sectioned, of a prior art 400 Series Double Revolving Disc Refiner made by The Bauer Bros. Co., Springfield, Ohio.
Figure 11:
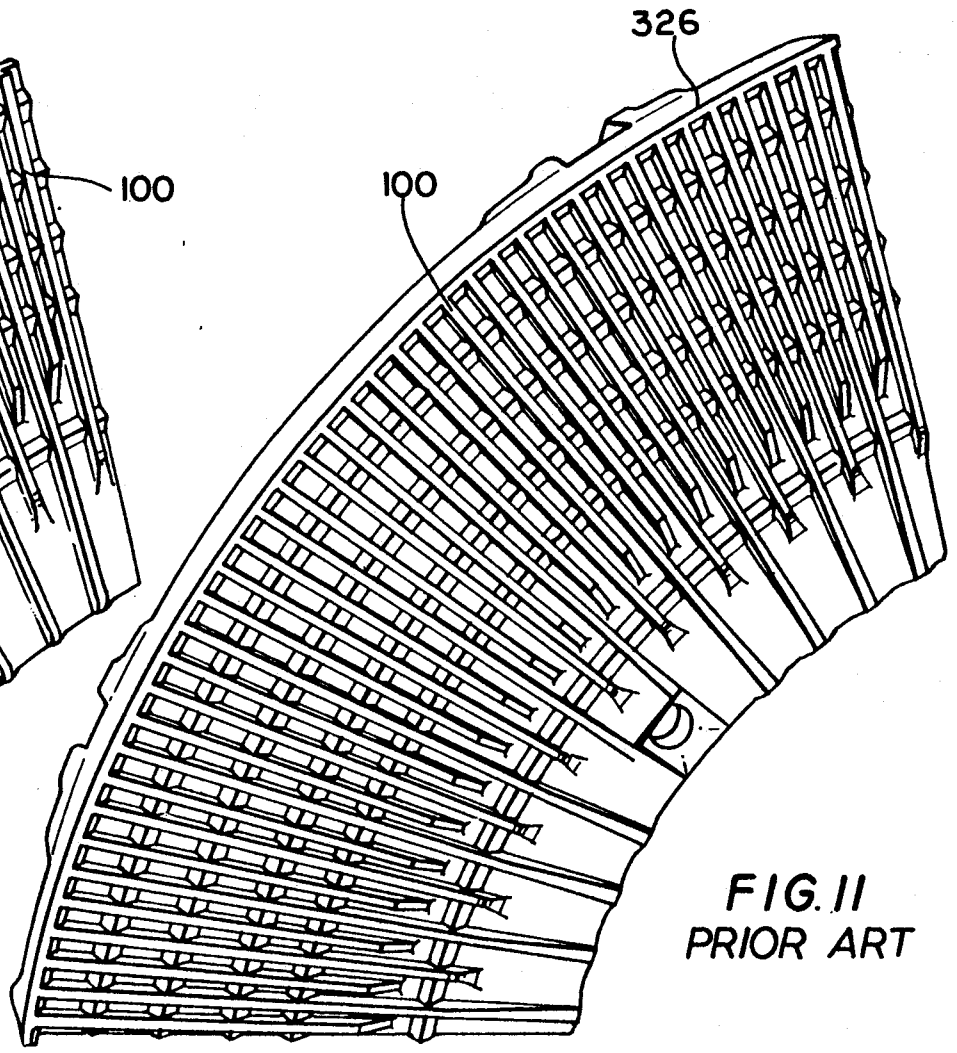
FIG. 11 PRIOR ART
FIG. 11 is a view of a prior art refiner disc plate segment 326 for the refiner of FIG. 9.
Figure 10:
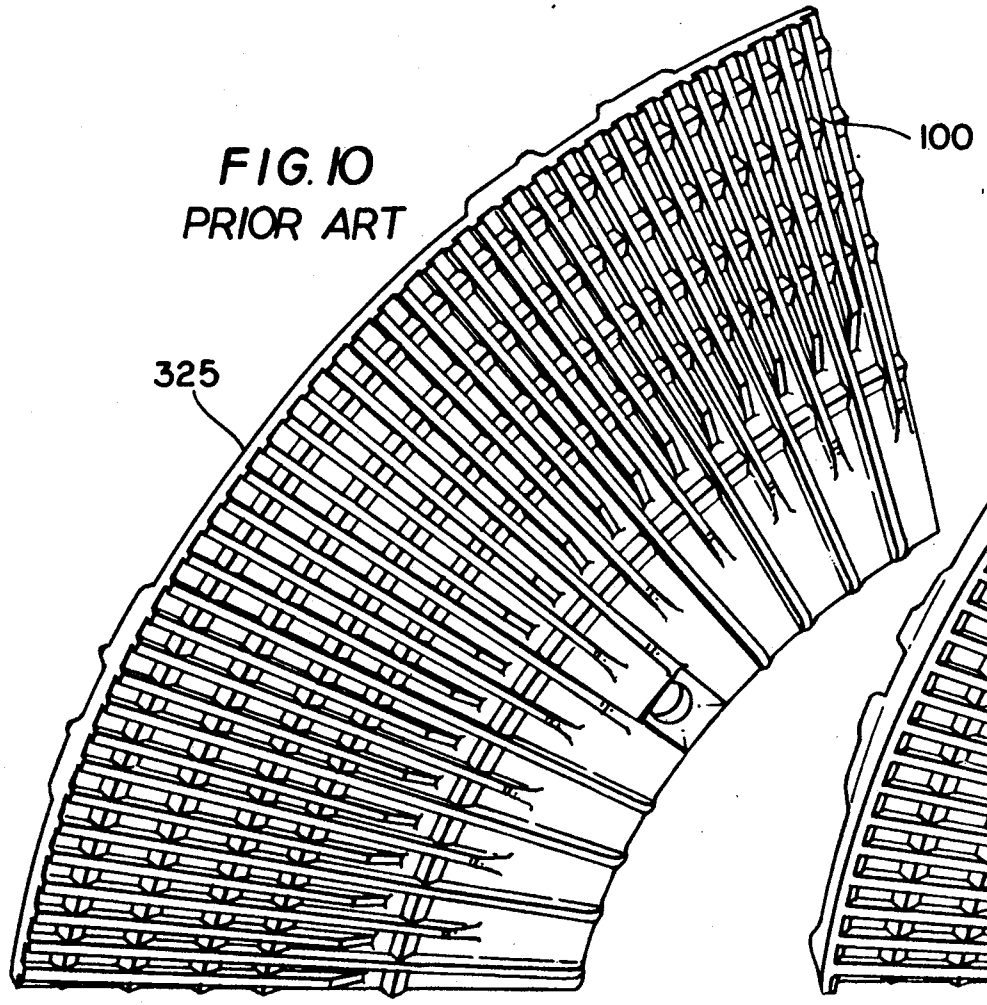
FIG. 10 PRIOR ART
FIG. 10 is a view of a prior art refiner disc plate segment 325 for the refiner of FIG. 9.

Leaf reduction apparatus used in carrying out methods in accordance with the invention are preferably of the kind in which a material flow path extends between and across opposed faces of first and second leaf reduction elements, such that there is provided a shearing action on tobacco material as the tobacco material traverses the material flow path. The faces may be substantially conoidal. Suitably, at least one of the leaf reduction elements is discoid, in which case it is advantageous that the discoid elements comprise, at the operative face thereof, generally linear, rib-form, radially extending projections. Preferably, both of the leaf reduction elements are discoid. Mills which comprise two leaf reduction elements taking the form of discs are exemplified by the Bauer model 400 (see FIG. 9, a side view partially cutaway) and the Quester model SMII (see FIG. 12, an open mill in-perspective-view). In operation of the Bauer model 400 mill the two discs (325, 326) are driven in opposite directions, whereas in the operation of the Quester model SMII mill one disc is rotated whilst the other remains stationary. A number of discs are available for the Bauer 400 mill, each of which discs is provided with a particular pattern of projections on the operative face thereof. Bauer plates designated 325 and 326 shown in FIGS. 10 and 11, respectively, as having discoid leaf reduction elements (100) are useful in carrying out the present invention.

In the operation of disc mills for the simultaneous milling of lamina and stem, determinants of the particle size of the product are the relative speed of rotation of the discs, the size of the gap between the discs and the configuration of the milling projections at the operative faces of the discs.

Another mill which it may be possible to use for purposes of the present invention is a so-called cross-beater mill, which mill comprises a barrel-form housing in which is rotatively mounted a rotor, the shaft of which is coaxial of the housing. The inner curved surface of the housing is provided with rib-form projections extending parallel to the axis of the housing, whilst the rotor carries three equi-angularly spaced blades which extend parallel to the rotor shaft and are disposed in close proximity to the rib-form projections of the housing.

It has been found that so-called "mills" of the kind which employ an impact action, such as hammer mills, will not generally be suitable for carrying out the desired milling action.

Figure 13:
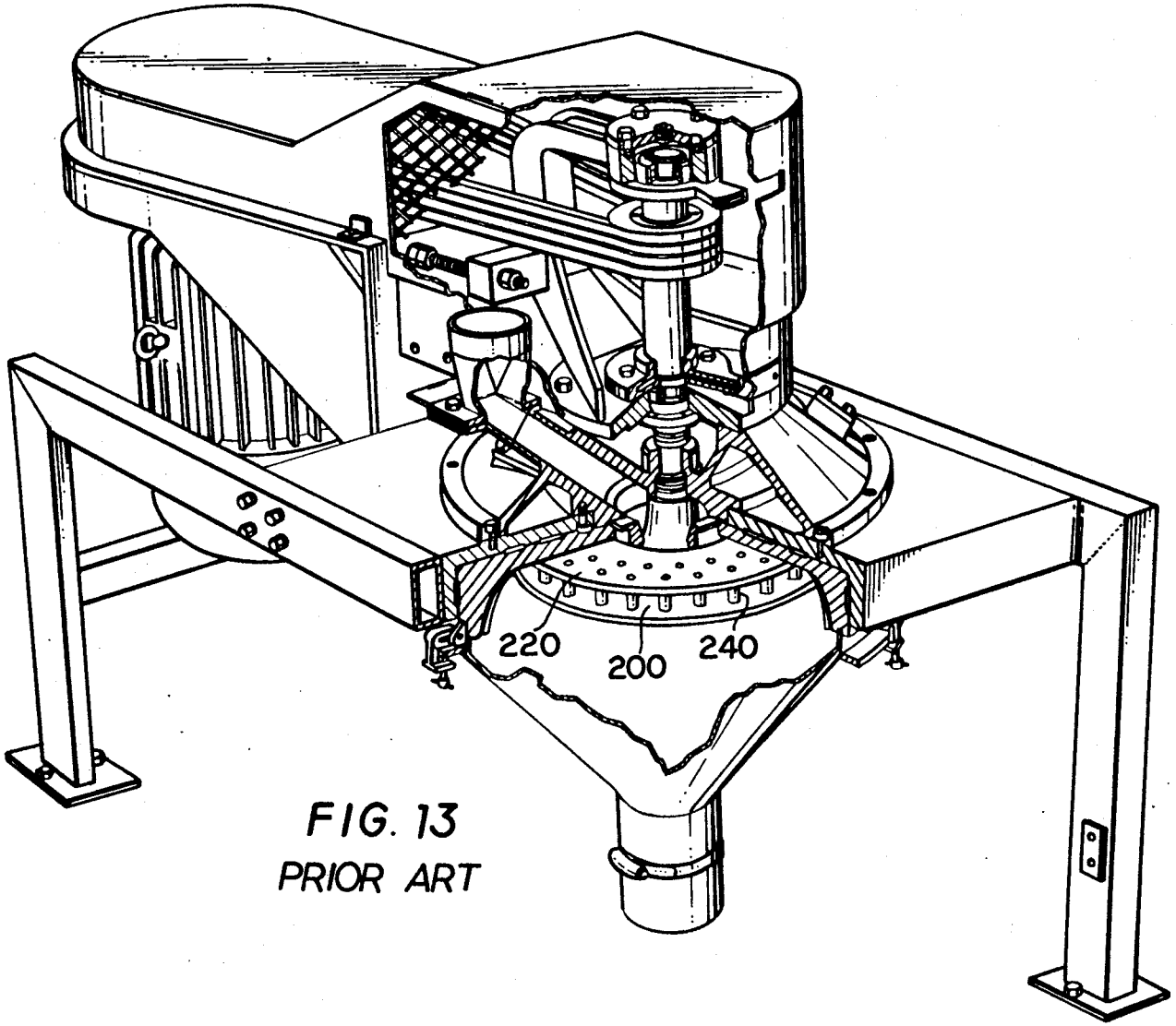
FIG. 13 PRIOR ART
FIG. 13 is a view-in-perspective, partially cut-away, of a prior art Sentry M3 Impact Disrupter.

We have examined a mill called a Robinson pin mill (model designation—Sentry M3 Impact Disrupter; see FIG. 13, a view-in-perspective). This mill comprises a rotative disc (200) and a disc-like stator (200), both of which elements are provided with circular arrays of pins (240) extending perpendicularly of the opposing faces of the elements. The pins of one element interdigitate with those of the other element. The limited experience gained with the Robinson pin mill indicated that such a mill might be useful in carrying out methods in accordance with the invention.

Any aging step may take place in respect of whole leaf as hereinbefore defined or the size-reduced material produced by the size reduction apparatus.

Products of the invention are fluent mixtures of lamina and stem particles and generally exhibit an angle of repose of not more than about 45 degrees, or even an angle of repose of not more than about 35 degrees, to the horizontal when at a conventional cigarette making moisture content, 13% say.

It has also been observed of products of the invention that the shape factor of about 60 percent or more of the dust free constituent particles is 0.5 or above. The shape factor of about 70 percent or more of the dust free particles may be 0.5 or above.

$$\text{Shape Factor} = \frac{4 \times \text{Area}}{(\text{Perimeter})^2}$$

The shape which has the maximum shape factor value, of one, is a circle.

It has further been observed that, generally the Borgwaldt filling value of products of the invention is less than that of comparable conventional tobacco smoking material. It has, however, been found, surprisingly, that the firmness of cigarettes comprising as a majority proportion of the filler a product of the invention is comparable to control cigarettes comprising conventional tobacco smoking material.

Advantageously, the particle size of products of the invention is characterised by 50% to 85% of the particles being retained on a sieve the apertures of which are of 1.4 mm × 1.4 mm square shape.

Preferably, products of the invention are substantially absent intact stem.

Products can be provided by the invention which can be fed to a smoking article making machine without being first subjected to further particle size reduction, or which require at most a minor degree only of further particle size reduction. That is not to say, of course, that a minor, heavy fraction and/or a minor dust fraction may not be removed from the product before incorporation of the product in smoking articles.

Figure 14:
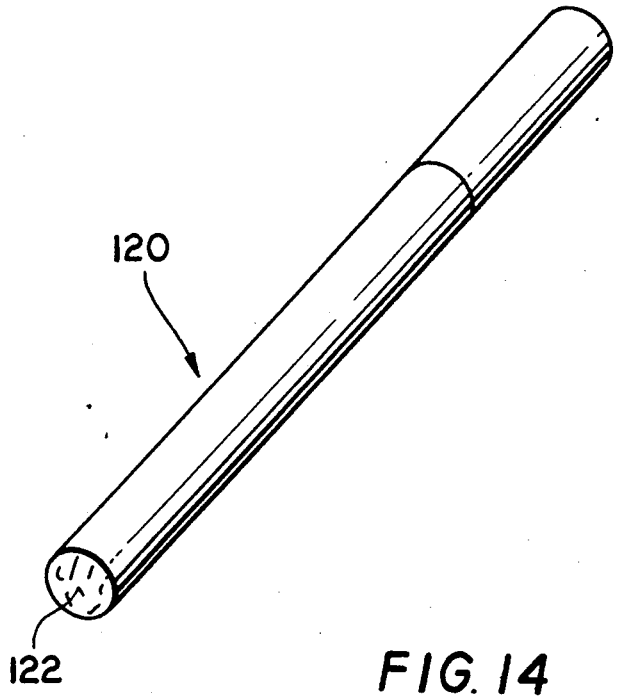
FIG. 14 is a view-in-perspective of a smoking article of the invention.

When incorporated in cigarettes by having been fed to a cigarette making machine, products of the invention have an appearance similar to that of conventional cigarette filler thus incorporated in cigarettes (120); see FIG. 14, a view-in-perspective.

Conventional cut tobacco smoking material which is used in the making of cigarettes is a long stranded, non-fluent, tangled material. For this reason the feed unit of cigarette making machines comprises carding means operative to disentangle the filler material. In that products of the invention are fluent, non-tangled mixtures of lamina and stem particles, when the products (122) shown in FIG. 14, are incorporated in cigarettes the carding means, or at least elements thereof, can be dispensed with.

If a leaf material size reduction process in accordance with the invention takes place in a tobacco growing region, the leaf material can be so-called "green leaf" material, i.e. cured leaf material as received from the tobacco farm. If, however, the leaf material is to be processed in a tobacco factory remote the tobacco growing region, it may be expedient to subject the tobacco to a so-called redrying process. A redrying process is used in order to ensure that the leaf material is at a low enough moisture content to render the leaf material suitable for transport to and storage at the factory without quality deterioration.

The use of whole tobacco leaf as a starting material for the preparation of smoking article filler material, without the necessity for a lamina/stem separation step, provides an economic advantage since it is to be expected that whole leaf would be less expensive to purchase than are the stem and lamina products of a threshing plant.

Conventional procedures can be applied to products of the invention in ways similar to those in which the procedures are applied to conventionally processed tobacco. For example, mixtures of shattered lamina flakes and stem shreds produced by a method in accordance with the invention can be blended in well known manner with another smoking material(s) in any ratio which is found desirable, but preferably at least the major proportion of the smoking material of the resulting blend is constituted by a product of a method in accordance with the invention. Smoking materials with which products of the invention may be blended include tobacco materials, reconstituted tobacco materials and tobacco substitute materials.

Products of the invention being of different tobacco grades can be blended.

In the blending of a U.S. type cigarette filler material there could be blended 1. the product provided by subjecting whole Virginia tobacco leaf to a method in accordance with the invention and 2. the lamina fraction of the product provided by subjecting whole Burley tobacco, at a moisture content below the transition moisture content, to a milling operation such that the product consist of a mixture of lamina particles and substantially intact stem lengths.

In order that the invention may be clearly understood and readily carried into effect reference will now be made, by way of example, to the accompanying drawings, of FIGS. 1-20.

In FIG. 1 the reference numerals indicate the following:

1—Conditioning/Drying
2—Desanding
3—Conditioning
4—Threshing
5—Stem
6—Drying
7—Packing
8—Stem
9—Conditioning
10—Blending
11—Rolling
12—Cutting
13—Water Treated Stem Process (WTS)
14—Drying
15—Lamina
16—Drying
17—Packing
18—Lamina
19—Conditioning
20—Blending
21—Cutting
22—Drying
23—Blending and Adding
24—Cut Tobacco Store
25—Cigarette Making Prior art Steps 1-4, 5-7 and 15-17 take place in a tobacco growing region, whereas steps 8-14, 18-22 and 23-25 take place in a cigarette factory, which factory is commonly far remote from the tobacco growing region. The process carried out at steps 8-14 and 18-22 constitute the primary leaf-process section of the factory, which section is sometimes referred to as the primary process department (PMD). The steps 8-14 are commonly referred to as constituting a "stem line", and the steps 18-22 as constituting a "lamina line".

The word "Adding" at step 23 refers to the possible addition of other smoking materials in the blending process of the products of the stem and lamina lines. Examples of such additional smoking materials are expanded tobacco and reconstituted tobacco.

The input material at step 1 is whole green tobacco leaf.

The overall process from step 1 to step 25 could be varied in detail, but FIG. 1 illustrates a typical conventional processing of tobacco leaf material to provide cigarette filler.

Figure 2:
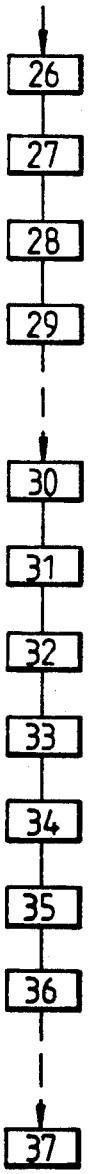
FIG. 2 is a block diagram relating to a processing of flue-cured whole tobacco leaf in accordance with the invention.

In FIG. 2 the reference numerals indicate the following:

26—Conditioning/Drying
27—Desanding
28—Drying
29—Packing
30—Whole Leaf
31—Conditioning
32—Blending
33—Milling
34—Drying
35—Blending and Adding
36—Buffer Store
37—Cigarette Making Steps 26-29 take place in the tobacco growing region and steps 30-37 take place in a cigarette factory.

The conditioning steps are carried out in such manner as to avoid, or substantially avoid, the removal of water extractible components.

The input material at step 26 is whole green tobacco leaf.

As may be observed from a comparison of the conventional processing method depicted in FIG. 1 and the inventive processing method depicted in FIG. 2, the latter method is much simpler.

Details will now be given of experiments relating to the invention.

EXPERIMENT 1

The tobacco leaf material used in this experiment was a single grade of Canadian flue-cured whole green leaf, which was purchased in farm bales of a moisture content of about 18%. The bales were sliced using a guillotine slicer to provide large leaf portions, in accordance with the definition of "whole leaf" hereinabove, the majority of which portions were about 10 cm to about 20 cm wide.

Figure 12:
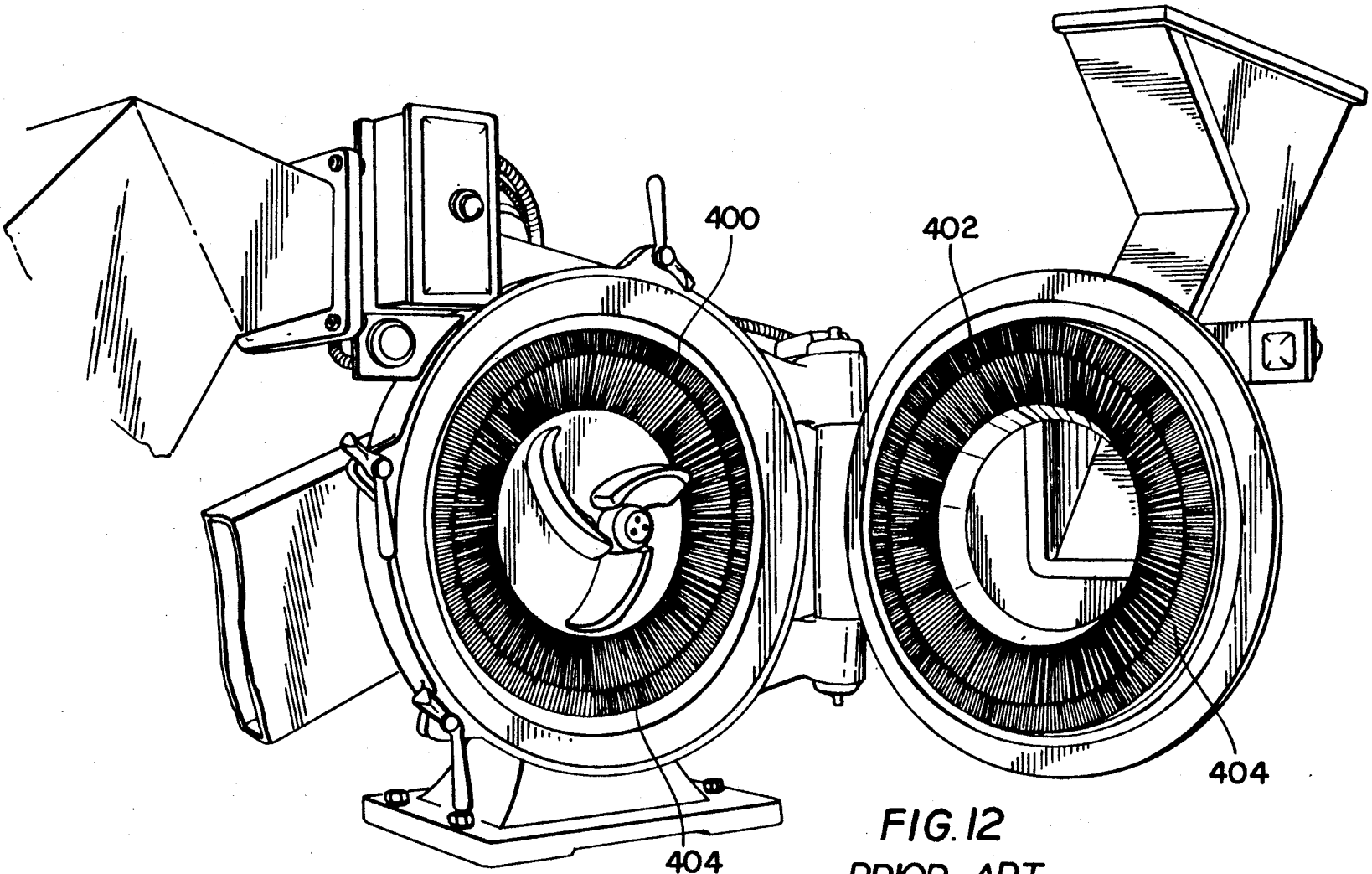
FIG. 12 PRIOR ART
FIG. 12 is a view of a prior art Quester disc refiner SM II, in the open position.

The whole leaf material thus obtained was conditioned to a moisture content of about 26% and was then gravity fed in continuous manner, at a rate of 150 kg/hr, to a Quester disc mill (model SMII see FIG. 12). The rotatable disc (400) of the mill was driven at 1,000 r.p.m. The rotatable disc and the stationary "disc" or plate (402), which were the standard such items for model SMII, comprised, at the operative, opposed faces thereof, a pattern of radially extending, linear, rib form projections (404).

The mill was operated at a nominal disc gap of 0.15 mm, and then at 0.15 mm increments of disc gap up to a nominal disc gap of 0.9 mm. Steam was supplied to the interior of the mill at 1 bar pressure.

The milled product obtained at each of the disc gap settings consisted of an intimate, fluent mixture of lamina particles and stem particles. All of the products were adjudged to be suitable for the manufacture of cigarettes on a conventional cigarette making machine. As was expected, as the disc gap was increased, the mean particle size of the products increased.

EXPERIMENT 2

Experiment 1 was repeated excepting that the whole leaf material was conditioned to a 24% moisture content and the nominal disc gaps were 0.15, 0.75 and 1.05 mm. The products obtained from the three runs again consisted of an intimate, fluent mixture of lamina particles and stem particles, all three products being adjudged to be suitable for the manufacture of cigarettes on a conventional cigarette making machine.

EXPERIMENT 3

The third run of Experiment 2, i.e. that with a nominal 1.05 mm disc gap setting was repeated, but with whole leaf material conditioned to a lower value of 21%. The product thus obtained consisted of a mixture of lamina particles and intact lengths of stem. Clearly then, the whole leaf material fed to the mill was of a moisture content which was less than the transition moisture content prevailing for the conditions appertaining to the experiment.

EXPERIMENT 4

Experiment 1 was repeated with the whole leaf material conditioned to a moisture content of 20% and with a feed rate of 180 kg/hr. Runs were made at nominal disc gap settings of 0.30 mm and 1.2 mm. When the nominal gap was 0.30 mm, the product was in accordance with the invention and consisted of an intimate, fluent mixture of lamina particles and stem particles. The product obtained when the nominal disc gap was 1.2 mm was, however, not in accordance with the invention and comprised a mixture of lamina particles and intact stem lengths.

A comparison of the results of this experiment and of Experiment 3 indicates that disc gap can be a determinant of the value of the transition moisture content.

EXPERIMENT 5

The tobacco leaf materials used in this experiment were three redried Zimbabwean flue-cured grades, designated A, B and C. These grades were bale sliced with the slicer set to produce 15 cm to 20 cm wide leaf portions. The whole leaf materials thus obtained were conditioned to a target moisture content of 24% and were then milled, one grade at a time, in the Quester SMII mill at a nominal disc gap of 0.3 mm.

The products obtained with the grades B and C were acceptable products in accordance with the invention, but the product obtained with grade A consisted of a mixture of lamina particles and intact stem lengths.

Upon examination it was observed that the stems of the leaves of the grade A material, as present in the leaves when taken from a bale, are exceptionally thick and are of a markedly woody appearance.

EXPERIMENT 8

Experiment 5 was repeated but the whole leaf materials of the grades A, B and C were mixed before being conditioned to a target mean moisture content of 24%. When the mixed material was fed through the Quester mill a product was produced which was in accordance with the invention, although the product contained a very small proportion (1.2%) of intact stem pieces. These stem pieces were easily removed from the product by elutriation.

EXPERIMENT 7

Lamina strips were mixed with stem at an 80:20 weight ratio. This mixture of materials, at a target mean moisture content of 24%, was milled in the Quester SMII with a nominal disc gap of 0.3 mm and with steam supplied at 1 bar pressure. There was thus produced a product in accordance with the invention, being an intimate, fluent mixture of lamina particles and stem particles.

EXPERIMENT 8

Whole leaf material the product of bale slicing was mixed with lamina strips at a 10:90 ratio. This mixture of materials at a target means moisture content of 24%, was milled in the Quester SMII mill with a nominal disc gap of 0.3 mm and with steam supplied at 1 bar pressure. There was thus produced a product in accordance with the invention, being an intimate, fluent mixture of lamina particles and stem particles. extending, linear, rib-form projections. The mill comprises air jets for the purpose of assisting the feed of the tobacco material through feed holes extending through the first encountered of the two discs. The milled product thus obtained was an intimate, fluent mixture of lamina particles and stem particles. The product was adjudged suitable for the manufacture of cigarettes on a conventional cigarette making machine.

It has been found generally that higher input leaf material moisture content values are required when the Bauer 400 mill is used than is the case in respect of the Quester SM11 mill.

EXPERIMENT 11

A 100 g sample of conventional U.S. flue cured cut lamina material was sieved using a sieve test apparatus comprising a box in which are disposed, one above another, five horizontally extending mesh sieves. The nominal apertures of the mesh sieves, from the top sieve down, are 1.98, 1.40, 1.14, 0.81 and 0.53 mm. The sieve test apparatus comprises reciprocative means operative to reciprocate the box and the sieves therein. The 100 g sample was evenly distributed on the upper sieve and the reciprocative means was put into operation for 10 minutes, after which time period the material fractions on the extending, linear, rib-form projections. The mill comprises air jets for the purpose of assisting the feed of the tobacco material through feed holes extending through the first encountered of the two discs. The milled product thus obtained was an intimate, fluent mixture of lamina particles and stem particles. The product was adjudged suitable for the manufacture of cigarettes on a conventional cigarette making machine.

It has been found generally that higher input leaf material moisture content values are required when the Bauer 400 mill is used than is the case in respect of the Quester SM11 mill.

EXPERIMENT 11

A 100 g sample of conventional U.S. flue cured cut lamina material was sieved using a sieve test apparatus comprising a box in which are disposed, one above another, five horizontally extending mesh sieves. The nominal apertures of the mesh sieves, from the top sieve down, are 1.98, 1.40, 1.14, 0.81 and 0.53 mm. The sieve test apparatus comprises reciprocative means operative to reciprocate the box and the sieves therein. The 100 g sample was evenly distributed on the upper sieve and the reciprocative means was put into operation for 10 minutes, after which time period the material fractions on the upper four sieves were recovered. The fraction on the lowermost sieve and the fraction that had passed through the lowermost sieve were of a fine dust form and were disregarded.

0.5 g sub-samples of the four recovered fractions were distributed on respective flat surfaces such that each lamina particle was spacially separated from the other particles. Each of the sub-samples was then subjected to geometric analysis by use of a Magiscan Image Analyser model 2 supplied by Joyce-Loebl; Marquisway, Team Valley, Gateshead, Tyne & Wear NE11 OQW, England. The analyser was set to obtain data as to particle area (two dimensional), length (greatest linear dimension) and perimeter length.

Figure 5:
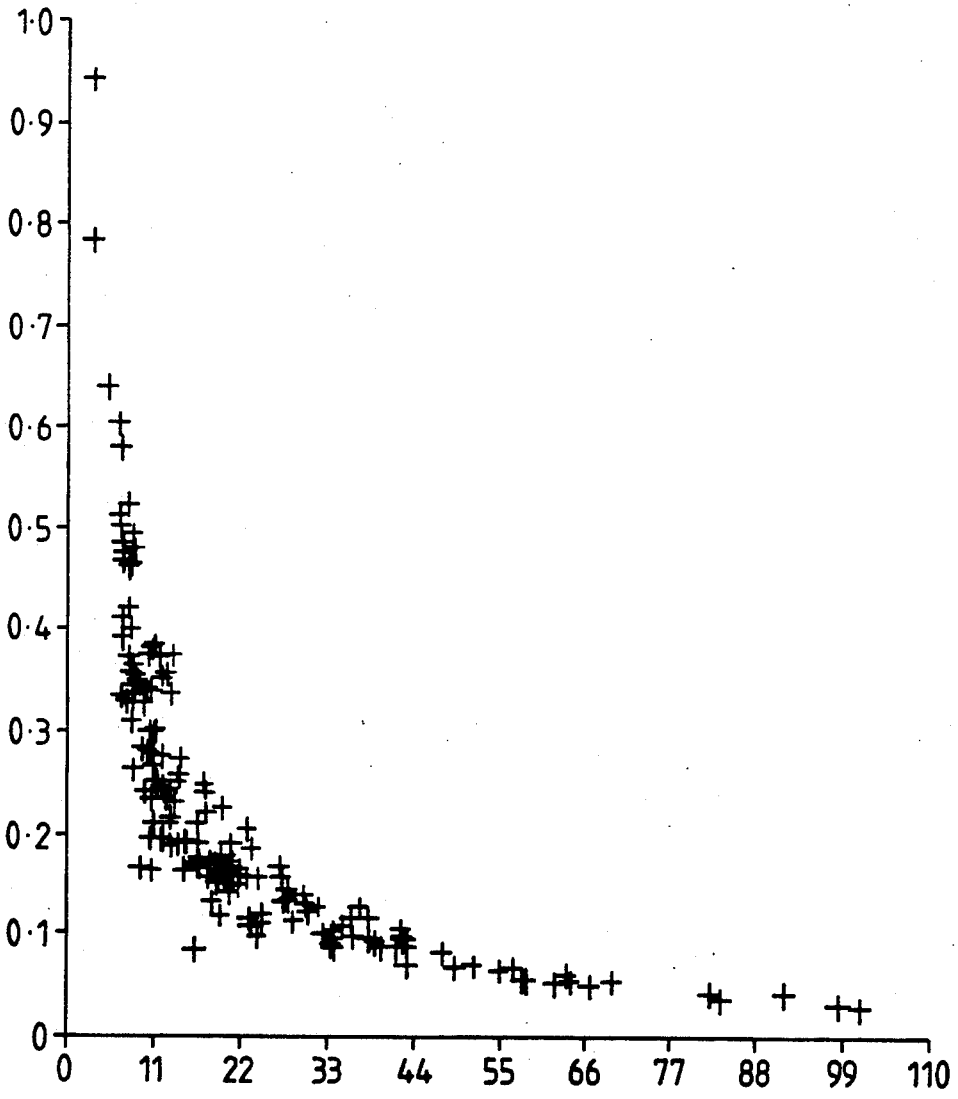
FIG. 5 is a scatter diagram relating particle length in millimeters (horizontal axis) to shape factor (vertical axis) for the conventional filler material the subject of FIG. 3.

From the data thus obtained there were produced a histogram relating particle shape factor to frequency of occurrence (FIG. 3) and a scatter diagram relating particle length to shape factor (FIG. 5).

EXPERIMENT 12

A 100 g sample of a product according to the invention, obtained by milling U.S. flue cured whole leaf material at 22% moisture content in the Quester mill at a 0.3 mm disc gap, was subjected to the sieving procedure detailed in Experiment 11. Four 0.5 g sub-samples, from the upper four sieves, i.e. dust free, were geometrically analysed as per Experiment 11.

Figure 4:
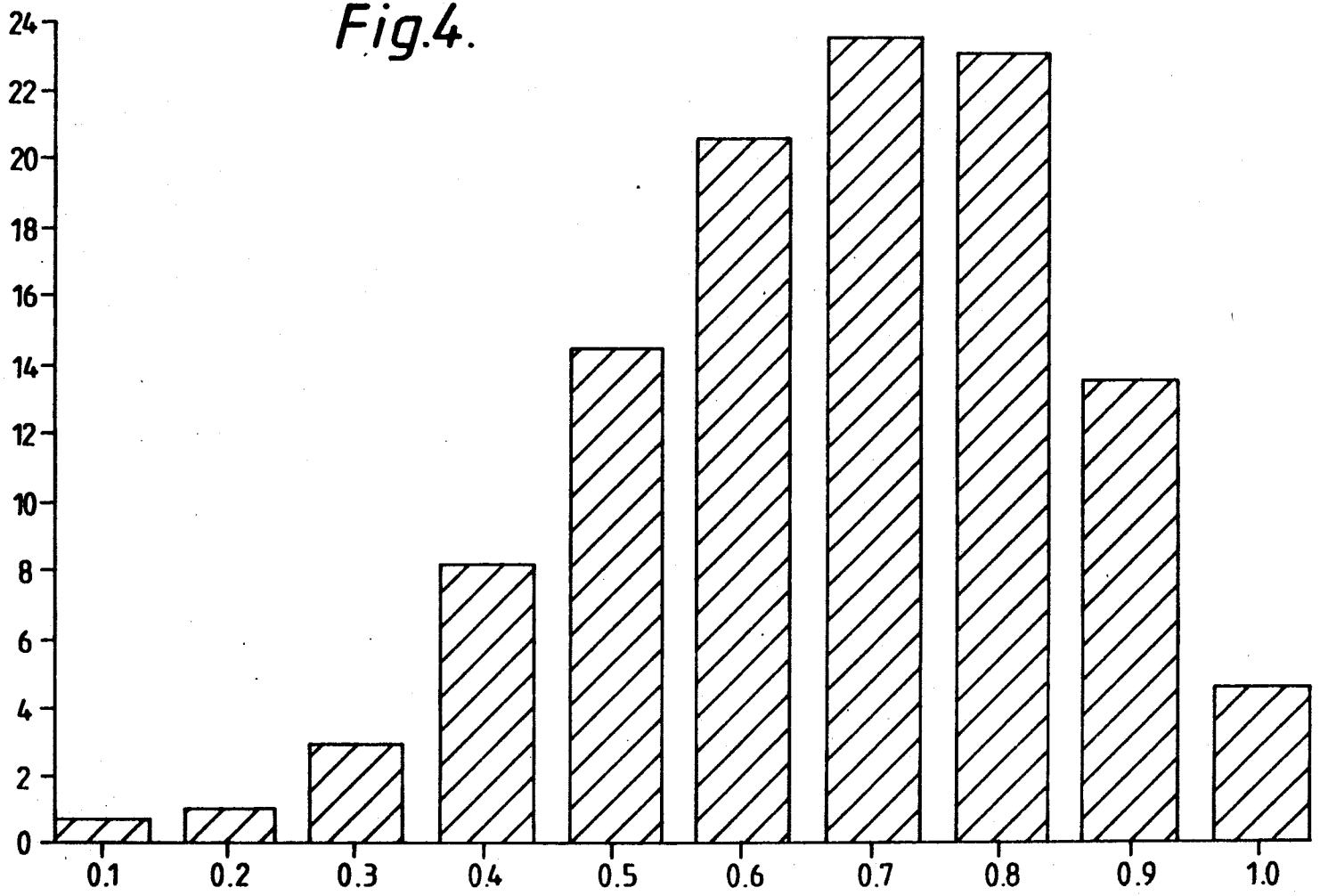
FIG. 4 is a histogram giving the same information to the same format as FIG. 3, but for a cigarette filler material a product of the invention.
Figure 6:
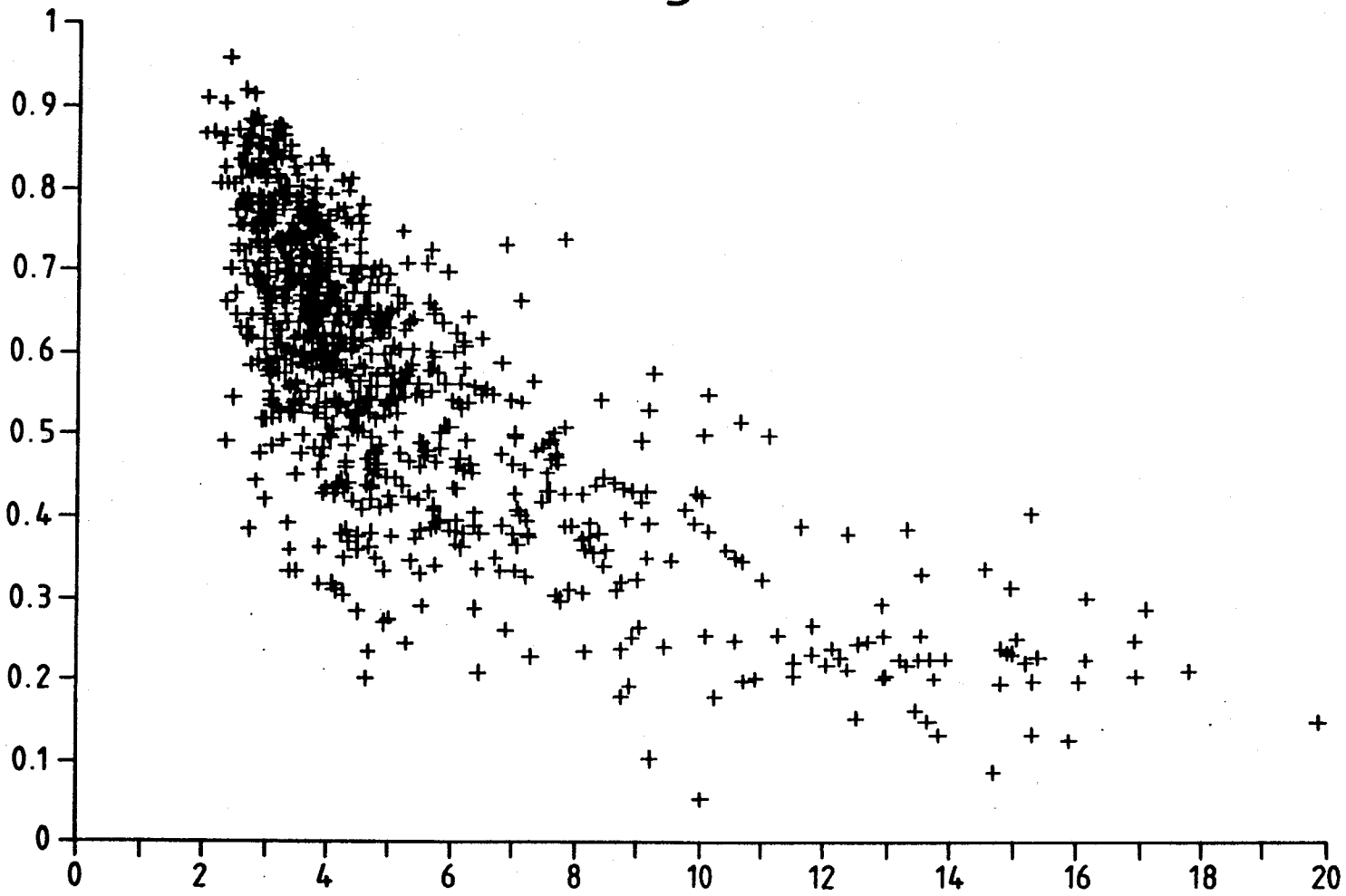
FIG. 6 is a scatter diagram relating particle length in millimeters (horizontal axis) to shape factor (vertical axis) for the filler material the subject of FIG. 4.

From the data thus obtained there were produced the shape factor/frequency histogram and the length/shape factor scatter diagram which constitute FIGS. 4 and 6 respectively.

Figure 3:
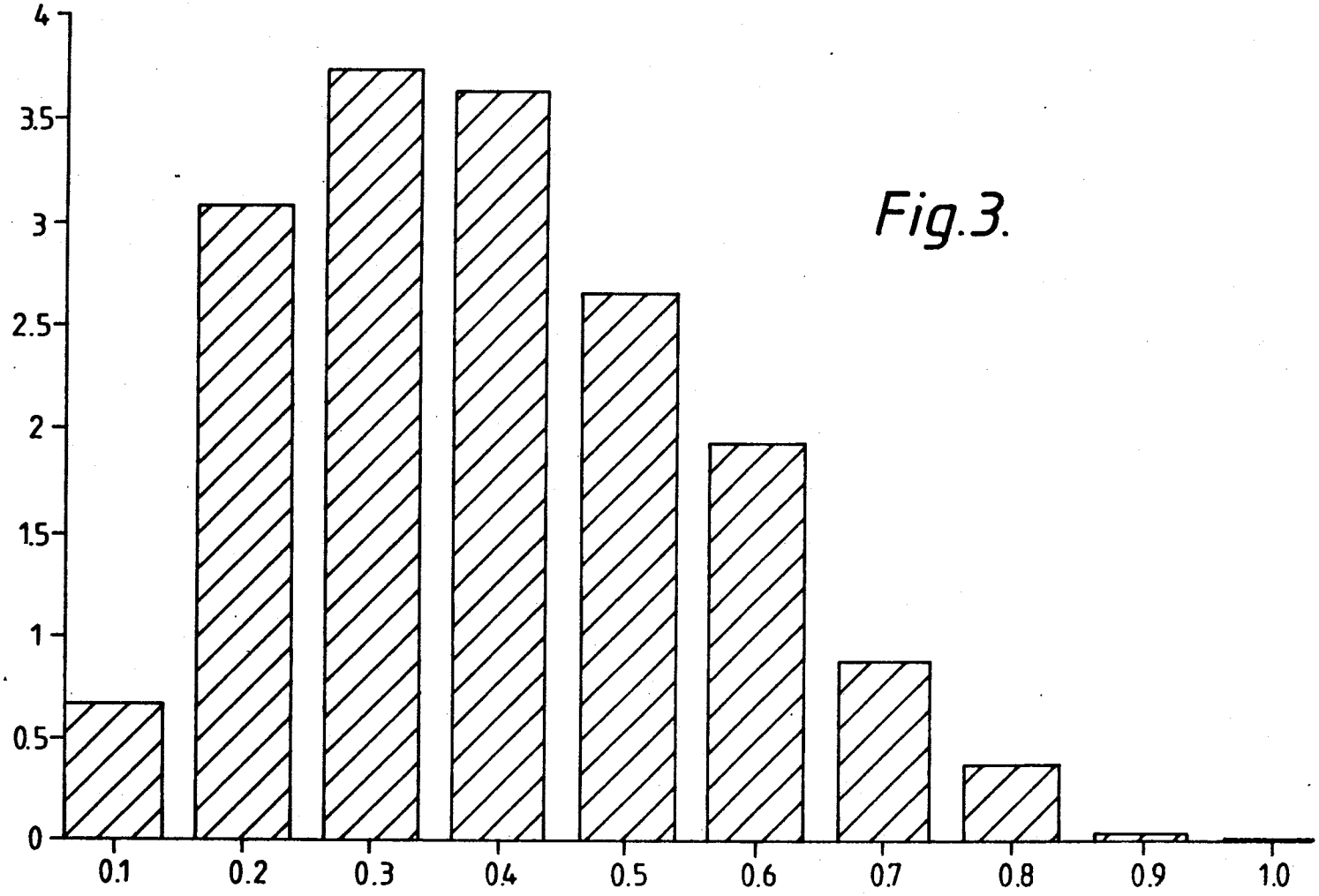
FIG. 3 is a histogram relating particle shape factor values (horizontal axis) to frequency of occurrence, measured in units of a million, (vertical axis) for a conventional cut lamina cigarette filler material.

A comparison between the histograms of FIGS. 3 and 4 shows the product of the invention (FIG. 4) to be of a distinctly different character from the conventional cut lamina material (FIG. 3). In this regard it may be observed, for example, that for the cut lamina material about 80% of the material, on a dust free basis, had a shape factor of 0.5 or less, whereas for the product according to the invention about 75% of the material, on a dust free basis, had a shape factor of 0.5 or above.

The distinctly different character of the two materials is also readily discerned from a perusal of FIGS. 5 and 6.

EXPERIMENT 13

Figure 7:
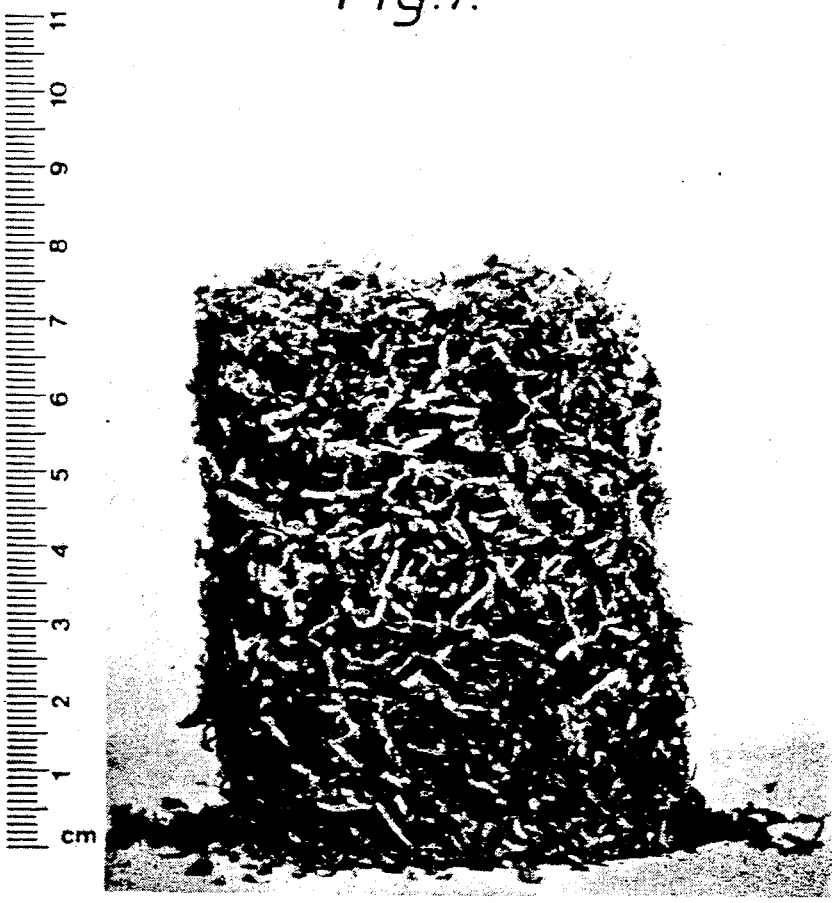
FIG. 7 shows a body of the conventional filler material the subject of FIGS. 3 and 5.

Conventional cut lamina material, of a blend of the grades A, B and C mentioned in respect of Experiment 5, at a moisture content of about 12.5% was placed in a 125 ml laboratory beaker without the application to the material in the beaker of any external compactive pressure. The beaker was then upturned on a flat, horizontal surface and the beaker was removed by lifting same vertically. The resultant body of cut lamina material is as depicted in FIG. 7. As may be observed, the angle of repose of the material is about 90 degrees to the horizontal.

EXPERIMENT 14

Figure 8:
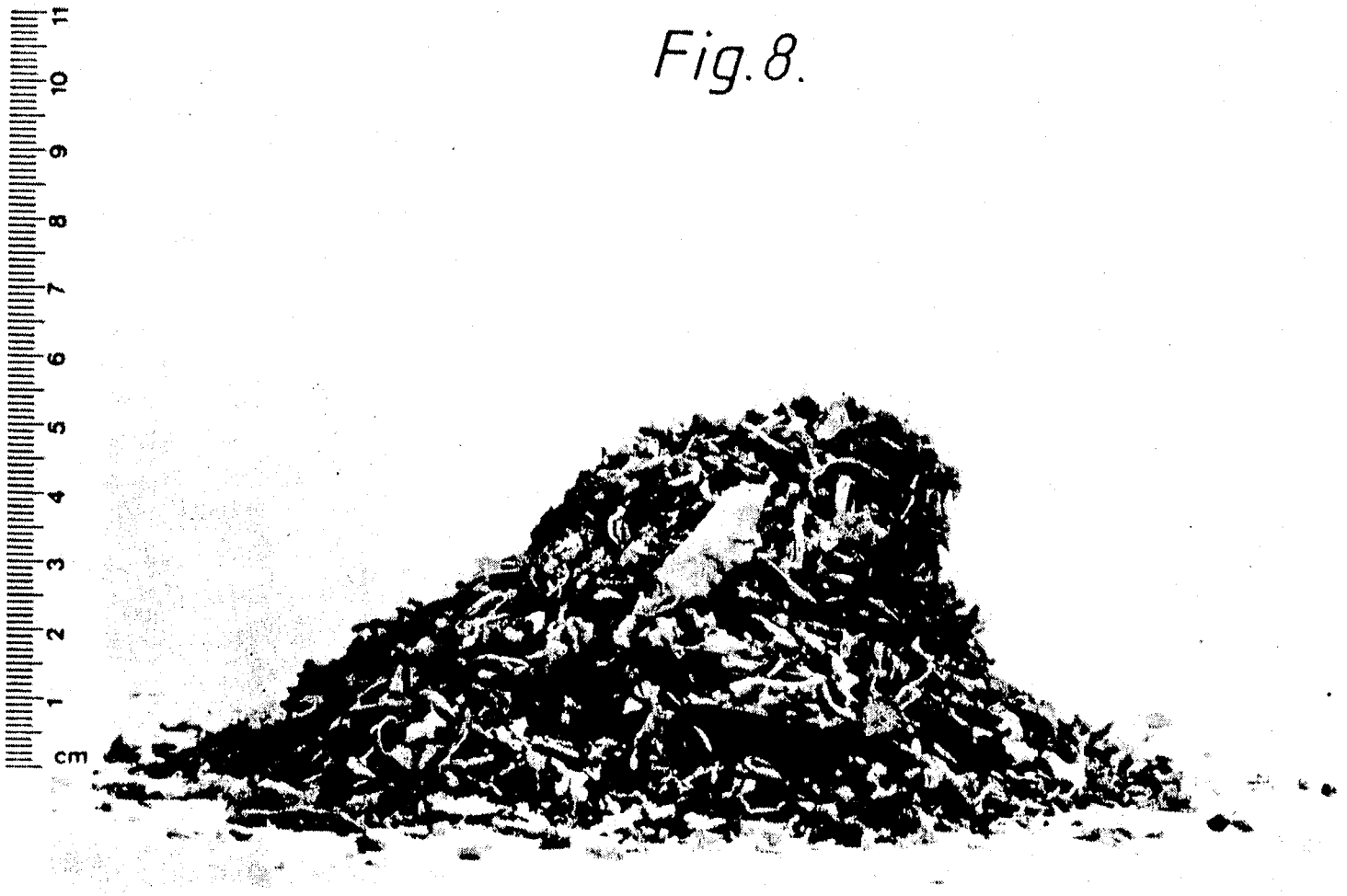
FIG. 8 shows a body of the filler material the subject of FIGS. 4 and 6.

Experiment 13 was repeated using a product of the invention, obtained from a whole leaf blend of the grades A, B and C mentioned in respect of Experiment 5, at a moisture content of about 12.5%. The resultant body of material is as depicted in FIG. 8. The angle of repose is about 33 degrees to the horizontal.

A comparison of FIGS. 7 and 8 again strongly evidences the very different characteristics of conventional lamina material and a material a product of the invention.

EXPERIMENT 15

Virginia lamina strips, Burley lamina strips and Oriental lamina strips, all of which were pre-cased, i.e. pretreated with a smoke modifying agent, were fed to a blending bin together with stem to provide a mixture in which the respective proportions of the four materials were 44%, 23%, 16% and 17% respectively. The mixture of the four materials, at a target moisture content of 24%, was fed to the Bauer 400 mill, which was operated with a disc gap of 2.7 mm and a disc drive speed of 700 r.p.m. The product was dried to a target moisture content of 14.5% and was then fed to a Molins Mk. 9.5 cigarette making machine, thus to make cigarettes the filler of which was composed 100% of the product.

We claim:

1. A method of processing tobacco leaf material which consists essentially of tobacco leaf lamina with tobacco leaf stem, which comprises; feeding the tobacco leaf lamina and the tobacco leaf stem together through a leaf reduction apparatus, wherein the moisture content of at least a major proportion of the tobacco leaf material is above the transition moisture content, the arrangement of said apparatus and the processing conditions being such that there exits said apparatus a product which is a mixture comprising flakes of said lamina and shreds of said stem.

2. A method according to claim 1, wherein said product requires substantially no further size reduction before being incorporated in smoking articles.

3. A method according to claim 1, wherein lamina and stem fed to said apparatus are comprised in whole leaf, as hereinbefore defined.

4. A method according to claim 1, wherein lamina fed to said apparatus is lamina prior separated from attached stem.

5. A method according to claim 1, wherein stem fed to said apparatus is stem prior separated from attached lamina.

6. A method according to claim 1, wherein said product is fluent.

7. A method according to claim 1, wherein the tobacco leaf material fed to said apparatus is gravity fed thereto.

8. A method according to claim 1, wherein said apparatus comprises first and second leaf reduction elements, a material flow path between and across opposed faces of said elements, and drive means operative to cause relative transverse movement between said elements.

9. A method according to claim 8, wherein at least one of said elements is discoid.

10. A method according to claim 8, wherein said faces are substantially conoidal.

11. A method according to claim 8, wherein said elements, at the said opposed faces thereof, comprise projections.

12. A method according to claim 11, wherein said projections are of generally linear configuration and said projections are disposed with the linear axes thereof extending perpendicularly of the direction of said relative movement between said elements.

13. A method according to claim 8, wherein said drive means is operative to drive one only of said elements.

14. A method according to claim 8, wherein said drive means is operative to drive both of said elements.

15. A method according to claim 8, wherein said relative movement is rotative relative movement.

16. A method according to claim 1, wherein said lamina and said stem pass once only through said apparatus.

17. A method according to claim 1, wherein during the passage of the leaf material through said apparatus, low pressure steam is brought into contact with said leaf material.

18. A method according to claim 1, wherein the flow of the leaf material to and through said apparatus is assisted by the maintenance at the product outlet of said apparatus of a reduced air pressure.

19. A method according to claim 1, wherein prior to the leaf material being fed to said apparatus, said leaf material or a part thereof is treated with a smoke modifying agent.

20. A method according to claim 1, wherein said product is subjected to a tobacco expansion process.

21. A method according to claim 1, wherein said product is incorporated in smoking articles.

22. A method according to claim 21, said smoking articles being cigarettes.

23. A method according to claim 21, said smoking articles being cigars.

24. A method according to claim 21, wherein said product is fed to a smoking article making machine.

25. A method according to claim 24, wherein, prior to being fed to said making machine, said product is subjected to no further particle size reduction, or to a minor degree only of further particle size reduction.

26. A method according to claim 21, wherein before said product is incorporated in smoking articles, said product is blended with another smoking material.

27. A smoking article comprising a smoking material which is the product of a method of processing tobacco leaf material according to claim 1.

28. A smoking article according to claim 27 and being a cigarette.

29. A smoking article according to claim 27 and being a cigar.

30. A tobacco smoking material product of claim 1 which comprises; a mixture of tobacco leaf lamina particles and tobacco leaf stem particles; about 60 percent or more of the dust free lamina particles having a shape factor of 0.5 or above.

31. A tobacco smoking material product of claim 1 which comprises; a mixture of tobacco leaf lamina particles and tobacco leaf stem particles, which material has a Borgwaldt filling value which is less than that of comparable conventional cut tobacco leaf lamina cigarette filler material.

32. The product of the process of claim 1.

33. A tobacco smoking material which comprises; a mixture of tobacco leaf lamina particles and tobacco leaf stem particles, which material has an angle of repose of not more than about 45 degrees to the horizontal.

34. A smoking material according to claim 31, the angle of repose thereof being not more than about 35 degrees to the horizontal.

35. A smoking material according to claim 33, the shape factor of about 60 percent or more of the dust free particles of which is 0.5 or above.

36. A smoking material according to claim 35, the shape factor of about 70 percent or more of the dust free particles of which is 0.5 or above.

37. A smoking material according to claim 33, the Borgwaldt filling value of which is less than that of comparable conventional cut lamina cigarette filler material.

38. A tobacco smoking article which comprises; a tobacco smoking material according to claim 31 in the form of a rod.

39. A smoking article according to claim 38 and being a cigarette.

40. A smoking article according to claim 38 and being a cigar.

41. A method of processing tobacco leaf material to provide smoking article filler material, wherein tobacco as whole leaf, as hereinbefore defined, passes through a passage defined by co-extensive portions of first and second, relatively moving, milling elements of a leaf reduction apparatus from an inlet of said passage to an outlet of said passage remote said inlet, so as to provide at said outlet filler material comprising a mixture of lamina particles and stem particles.

42. A method according to claim 41, wherein said outlet is situated at the margin of the co-extensive portions.

43. Smoking article filler material the product of a method according to claim 41 or 42.

44. A method of making smoking articles, wherein filler material the product of the method according to claim 41 or 42 is fed to a smoking article making machine.

45. A smoking article, which smoking article is the product of the method according to claim 44.

46. Smoking article filler material, which filler material is a fluent mixture comprising lamina particles and stem particles, the shape factor of about 60 percent or more of the dust free particles of which mixture is 0.5 or above.

47. A method of making smoking articles, wherein filler material according to claim 46 is fed to a smoking article making machine.

48. A smoking article, which smoking article is the product of the method according to claim 47.

49. A method of making cigarettes, wherein tobacco bale material is reduced to provide discrete whole leaf, as hereinbefore defined; the whole leaf is fed through a mill such that there exits said mill a product which is a mixture comprising flakes of lamina and shreds of stem; and said mixture is fed to a cigarette rod making machine.

* * * * *

UNITED STATES PATENT AND TRADEMARK OFFICE

CERTIFICATE OF CORRECTION

PATENT NO. : 5,165,426

DATED : November 24, 1992

INVENTOR(S) : Barbara C. Klammer; David J. Molyneux and Roy L. Prowse

It is certified that error appears in the above-identified patent and that said Letters Patent is hereby corrected as shown below:

Col. 10, line 26; "EXPERIMENT 8" should read

-- EXPERIMENT 6 -- .

Col. 10, line 56; after the word "particles" insert a period and delete the remainder of the text starting with the word "extending" and ending at line 68 with "Quester SMll mill".

Insert "EXPERIMENT 9" and "EXPERIMENT 10" per attached two sheets.

UNITED STATES PATENT AND TRADEMARK OFFICE

CERTIFICATE OF CORRECTION

PATENT NO. : 5,165,426

DATED : November 24, 1992

INVENTOR(S) : Barbara C. Klammer; David J. Molyneux and Roy L. Prowse

It is certified that error appears in the above-indentified patent and that said Letters Patent is hereby corrected as shown below:

Column 11, lines 1-25; delete lines 1-25 "EXPERIMENT 11" first instance.

Signed and Sealed this

Twenty-eighth Day of December, 1993

Bruce Lehman

*Attest:*

BRUCE LEHMAN

*Attesting Officer*

*Commissioner of Patents and Trademarks*